United States Patent [19]

Peck et al.

[11] Patent Number: 4,746,419

[45] Date of Patent: May 24, 1988

[54] PROCESS FOR THE HYDRODEMETALLATION HYDRODESULFURATION AND HYDROCRACKING OF A HYDROCARBON FEEDSTOCK

[75] Inventors: Lawrence B. Peck, Glen Ellyn, Ill.; Albert L. Hensley, Munster, Ind.; George L. Ott, Naperville, Ill.

[73] Assignee: Amoco Corporation, Chicago, Ill.

[21] Appl. No.: 71,478

[22] Filed: Jul. 9, 1987

Related U.S. Application Data

[63] Continuation of Ser. No. 811,722, Dec. 20, 1985, abandoned.

[51] Int. Cl.[4] ..... C10G 45/04; C10G 47/11

[52] U.S. Cl. ..... 208/213; 208/59; 208/108; 208/112; 208/216 PP; 208/127; 208/128; 208/251 H

[58] Field of Search ..... 208/251 H, 216 PP, 108, 208/112, 127, 128, 59, 213

[56] References Cited

U.S. PATENT DOCUMENTS

| | | | |
|---|---|---|---|
| 3,692,697 | 9/1972 | Kravitz et al. | 208/112 |
| 3,887,455 | 6/1975 | Hamner et al. | 208/112 |
| 3,956,105 | 5/1976 | Conway | 208/112 |
| 4,119,531 | 10/1978 | Hopkins et al. | 208/251 H |
| 4,225,421 | 9/1980 | Hensley, Jr. et al. | 208/216 PP |
| 4,341,625 | 7/1982 | Tamm | 208/216 PP |
| 4,395,328 | 7/1983 | Hensley, Jr. et al. | 208/216 PP |
| 4,395,329 | 7/1983 | LePage et al. | 208/216 PP |
| 4,411,824 | 10/1983 | Chen | 208/251 H |
| 4,414,141 | 11/1983 | Schindler | 208/216 PP |
| 4,434,048 | 2/1984 | Schindler | 208/112 |
| 4,435,278 | 3/1984 | Chen . | |
| 4,454,026 | 6/1984 | Hensley, Jr. et al. . | |
| 4,495,067 | 1/1985 | Hensley, Jr. et al. . | |
| 4,530,754 | 7/1985 | Shiroto et al. | 208/216 PP |
| 4,549,957 | 10/1985 | Hensley, Jr. et al. . | |
| 4,657,664 | 4/1987 | Evans et al. | 208/216 PP |

*Primary Examiner*—Helen M. S. Sneed
*Assistant Examiner*—Helane Myers
*Attorney, Agent, or Firm*—Ekkehard Schoettle; William H. Magidson; Ralph C. Medhurst

[57] ABSTRACT

Disclosed is an improved hydroconversion process for the hydroconversion of heavy hydrocarbon feedstocks containing asphaltenes, metals, and sulfur compounds which process minimizes the production of carbonaceous insoluble solids and catalyst attrition rates. The process is characterized by the use of a catalyst which has about 0.1 to about 0.3 cc/gm of its pore volume in pores having diameters greater than 1,200Å and no more than 0.1 cc/gm of its pore volume in pores having diameters greater than 4,000Å.

9 Claims, 2 Drawing Sheets

PROCESS FOR THE HYDRODEMETALLATION HYDRODESULFURATION AND HYDROCRACKING OF A HYDROCARBON FEEDSTOCK

This is a continuation of application Ser. No. 811,722, filed 12/20/85, now abandoned.

BACKGROUND

This invention relates to a catalytic process for hydroconversion of heavy hydrocarbon streams containing asphaltenic material, metals, and sulfur compounds. More particularly, this invention relates to hydroconversion using a catalyst having improved effectiveness and activity maintenance in the desulfurization and demetallation of metal-containing heavy hydrocarbon streams which produce insoluble carbonaceous substances also known as Shell hot filtration solids, dry sludge, and hexane insolubles.

As refiners increase the proportion of heavier, poorer quality crude oil in the feedstock to be processed, the need grows for processes to treat the fractions containing increasingly higher levels of metals, asphaltenes, and sulfur.

It is widely known that various organometallic compounds and asphaltenes are present in petroleum crude oils and other heavy petroleum hydrocarbon streams, such as petroleum hydrocarbon residua, hydrocarbon streams derived from tar sands, and hydrocarbon streams derived from coals. The most common metals found in such hydrocarbon streams are nickel, vanadium, and iron. Such metals are very harmful to various petroleum refining operations, such as hydrocracking, hydrodesulfurization, and catalytic cracking. The metals and asphaltenes cause interstitial plugging of the catalyst bed and reduced catalyst life. The various metal deposits on a catalyst tend to poison or deactivate the catalyst. Moreover, the asphaltenes tend to reduce the susceptibility of the hydrocarbons to desulfurization. If a catalyst, such as a desulfurization catalyst or a fluidized cracking catalyst, is exposed to a hydrocarbon fraction that contains metals and asphaltenes, the catalyst will become deactivated rapidly and will be subject to premature replacement.

Although processes for the hydrotreating of heavy hydrocarbon streams, including but not limited to heavy crudes, reduced crudes, and petroleum hydrocarbon residua, are known, the use of fixed-bed catalytic processes to convert such feedstocks without appreciable asphaltene precipitation and reactor plugging and with effective removal of metals and other contaminants, such as sulfur compounds and nitrogen compounds, are not common because the catalysts employed have not generally been capable of maintaining activity and performance.

Thus, the subject hydrotreating processes are most effectively carried out in an ebullated bed system. In an ebullated bed, preheated hydrogen and resid enter the bottom of a reactor wherein the upward flow of resid plus an internal recycle suspend the catalyst particles in the liquid phase. Recent developments involved the use of a powdered catalyst which can be suspended without the need for a liquid recycle. In this system, part of the catalyst is continuously or intermittently removed in a series of cyclones and fresh catalyst is added to maintain activity. Roughly about 1 wt. % of the catalyst inventory is replaced each day in an ebullated bed system.

Thus, the overall system activity is the weighted average activity of catalyst varying from fresh to very old, i.e., deactivated.

Hopkins et al. in U.S. Pat. No. 4,119,531 disclose a process for hydrodemetallation of hydrocarbon streams containing asphaltenes and a substantial amount of metals, which comprises contacting the hydrocarbon stream with a catalyst consisting essentially of a small amount of a single hydrogenation metal from Group VIB or Group VIII, deposed on a large pore alumina; suitable examples of the hydrogenation metal are nickel or molybdenum. The catalyst is characterized by a surface area of at least 120 $m^2/gm$; a pore volume of at least 0.7 cc/gm and an average pore diameter of at least 125Å units.

Hensley et al. in U.S. Pat. No. 4,549,957 discloses a hydrotreating process which utilizes a catalyst comprising a porous refractory inorganic oxide wherein the catalyst has a BET surface area of 150 to about 190 $m^2/g$, a micropore volume of about 0.9 to about 1.3 cc/g as determined by nitrogen desorption in micropores having radii up to 600Å, with at least 0.7 cc/g of such micropore, volume in micropores with radii ranging from 50 to 600Å, and a pore volume of 0.15 to about 0.5 cc/gm as determined by mercury penetration in macropores having radii of 600 to 25,000Å.

Hensley et al. in U.S. Pat. No. 4,297,242 discloses a multiple-stage catalytic process for hydrodemetallation and hydrodesulfurization of heavy hydrocarbon streams containing asphaltenes and a substantial amount of metals. The first stage of this process comprises contacting the feedstock in a first reaction zone with hydrogen and a demetallation catalyst comprising hydrogenation metal selected from Group VIB and/or Group VIII deposed on a large-pore, high surface area inorganic oxide support; the second stage of the process comprises contacting the effluent from the first reaction zone with a catalyst consisting essentially of hydrogenation metal selected from Group VIB deposed on a smaller pore, catalytically active support comprising alumina, said second stage catalyst having a surface area within the range of about 150 $m^2/gm$ to about 300 $m^2/gm$, an average pore diameter within the range of about about 90Å to about 160Å, and the catalyst has a pore volume within the range of about 0.4 cc/gm to about 0.9 cc/gm. Hensley et al. disclose that as little as 2.2 wt. % cobalt oxide caused more rapid deactivation of their second-stage catalyst for sulfur removal.

In U.S. Pat. No. 4,212,729 to Hensley et al., another two-stage catalytic process for hydrodemetallation and hydrodesulfurization of heavy hydrocarbon streams containing asphaltenes and metals is disclosed. In this process, the first-stage demetallation catalyst comprises a metal selected from Group VIB and from Group VIII deposed on a large-pore, high surface area inorganic oxide support. The second stage catalyst contains a hydrogenation metal selected from Group VIB deposed on a smaller pore catalytically active support having the majority of its pore volume in more diameters within the range of about 80Å to about 130Å.

Other examples of multiple-stage catalytic processes for hydrotreatment of heavy hydrocarbon streams containing metals are disclosed in U.S. Pat. Nos. 3,180,820 (Gleim et al., 1965); 3,730,879 (Christman, 1973); 3,977,961 (Hamner, 1976); 3,985,684 (Arey, et al., 1977); 4,016,067 (Fischer, 1977); 4,054,508 (Milstein, 1977); 4,051,021 (Hamner, 1977); and 4,073,718 (Hamner, 1978).

The catalysts disclosed in these references contain hydrogenating components comprising one or more metals from Group VIB and/or Group VIII on high surface area support such as alumina, and such combinations of metals as cobalt and molybdenum, nickel and molybdenum, nickel and tungsten, and cobalt, nickel, and molybdenum have been found useful. Generally, cobalt and molybdenum have been preferred metals in the catalysts disclosed for hydrotreatment of heavy hydrocarbon streams, both in first-stage catalytic treatment to primarily remove the bulk of the metal contaminants, and in second-stage catalytic treatment primarily for desulfurization.

A difficulty which arises in resid hydroprocessing units employing the above catalyst systems is the formation of insoluble carbonaceous substances also known as Shell hot filtration solids. These substances cause operability problems in the hydrotreating units. Certain resids tend to produce greater amounts of solids thereby limiting the level of upgrading by the amount of these solids the hydroprocessing unit can tolerate.

Further, the higher the conversion level for given feedstocks the greater the amount of solids formed. In high concentrations, these solids accumulate in lines and separators, causing fouling, and in some cases interruption or loss of process flow. The formation of these solids results in the agglomeration of the catalyst, thereby causing high pressure drops through fixed catalyst beds. In an ebullated bed type reactor, catalyst agglomeration can prevent proper mixing of the oil, hydrogen, and catalyst which allows uncontrolled reactions and local hot spots that can result in reactor failure, serious fires, or explosion.

To avoid these problems, refiners have taken several measures. Conversion has been limited to 40 to 70 volume or solids have been removed after a partial initial conversion of the feedstock prior to further conversion. Further, refiners have been limited in their choice of feedstocks by having to avoid the use of or limit the conversion of feedstocks that have a greater tendency to produce the subject solids.

Accordingly, it is a general object of this invention to provide a process affording a higher conversion level for heavy hydrocarbon feedstocks that tend to form greater amounts of insoluble substances, especially that fraction of the feedstock that boils over 1,000° F.

It is another object of the present invention to provide a process that can tolerate larger amounts of insoluble carbonaceous substance producing feedstocks in the feed stream to the process.

These objectives can be attained by the process of the present invention which utilizes a novel catalyst to effect the hydroconversion of heavy hydrocarbon streams in a series of ebullated bed reaction zones or fixed bed reaction zones. It has been discovered that the requisite low solids formation with increased conversion can be attained by using a catalyst comprising an inorganic oxide having a pore volume of pores having a diameter greater than 1,200Å of about 0.1 to about 0.3 cc/gm and not having more than about 0.15 cc/gm poreovolume in pores having a diameter greater than 4,000Å. Further, the process of the present invention provides for a process, wherein there is a minimal or acceptable loss of catalyst by attrition since the presence of large pores generally exacerbate the catalyst attrition problem.

In the two-stage prior art processes, such as those disclosed in U.S. Pat. Nos. 4,297,242 and 4,212,729, the demetallation catalyst is followed by a smaller-pore hydrotreating catalyst. The use of these smaller-pore hydrotreating catalysts as taught in the above two U.S. Pat. Nos. (4,297,242 and 4,212,729), results in the formation of carbonaceous insoluble solids causing operability difficulties. Further, the use of the catalyst disclosed in U.S. Pat. No. 4,549,957 could result in an unacceptably high catalyst attrition rate, since the macropore volume range of the catalyst disclosed therein encompasses catalysts possessing pore volumes greater than 0.15 cc/g for pores having diameters greater than 4000Å.

SUMMARY OF THE INVENTION

Figure 1:
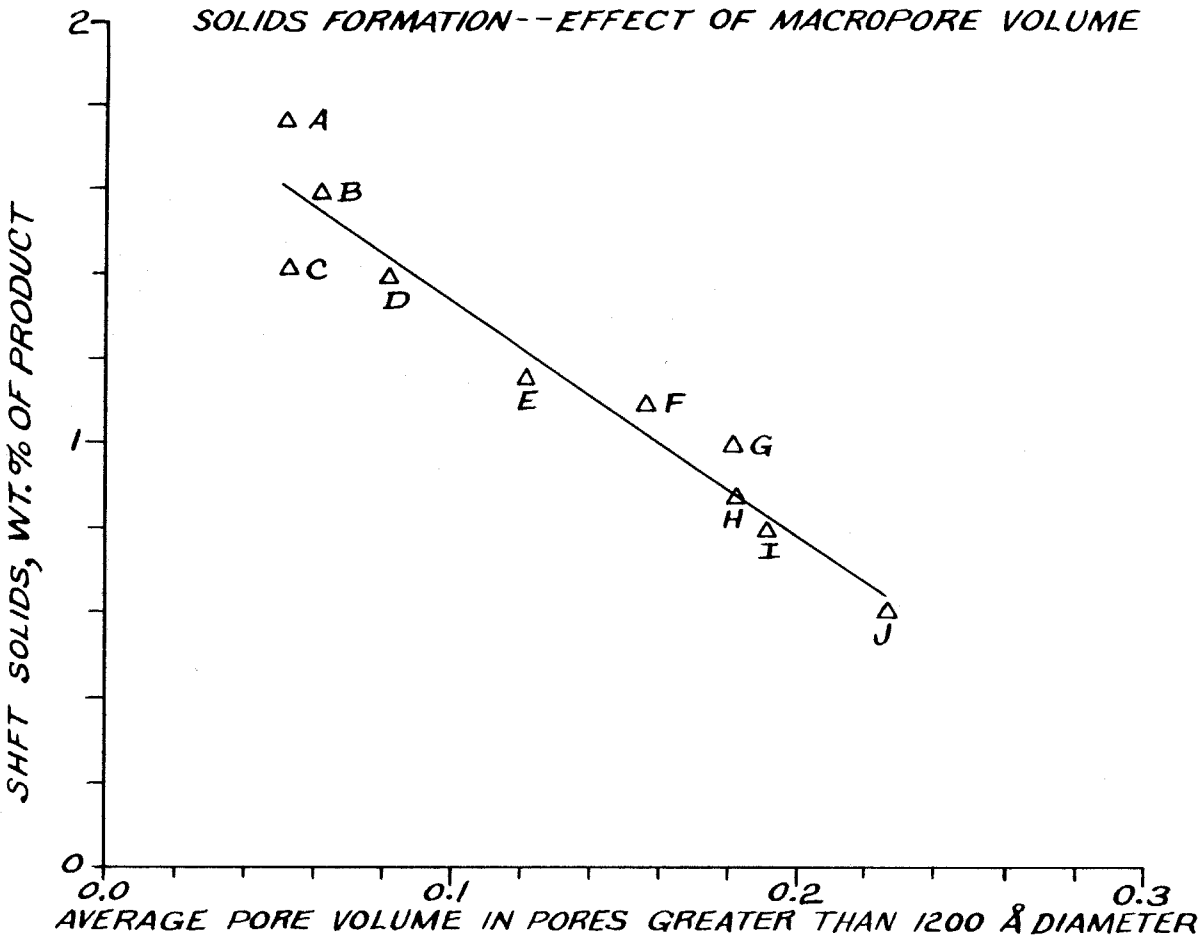
FIG. 1 depicts a plot of Shell hot filtration solids versus macropore volume in pores having diameters greater than 1,200Å for various catalysts including catalysts falling within the purview of the present invention.

This invention comprises a process for the hydrodemetallation, hydrodesulfurization and hydroconversion of a hydrocarbon feedstock containing asphaltenes, a substantial amount of metals and Shell hot filtration solids precursors. More particularly, in the process of the invention, the hydrocarbon feedstock is contacted with hydrogen in one or a series of ebullated bed reaction zones in the presence of a hydroconversion catalyst comprising a porous inorganic oxide having a pore volume of pores having a diameter greater than 1,200Å of about 0.1 to about 0.3 cc/g and having not more than about 0.15 cc/g pore volumes in pores having a diameter greater than about 4,000Å.

It is believed the large pores in the hydrotreating catalyst afford surface area accessibility to the large asphaltenic molecules that are implicated in the formation of insoluble carbonaceous substances also known as Shell hot filtration solids. Additionally, metals present in the feedstock such as vanadium and nickel are deposited in these large pores.

The process of the invention converts at least 30 vol. % of the hydrocarbon fraction boiling above 1,000° F. to material boiling below 1,000° F. and preferably 60 vol. % of the material boiling above 1,000° F. to a material boiling below 1,000° F.

DETAILED DESCRIPTION OF THE INVENTION

Broadly, the present invention is directed to a process for the hydroconversion of heavy hydrocarbon feedstocks which contain asphaltenes, metals, nitrogen compounds, and sulfur compounds. As is well known these feedstocks contain nickel, vanadium, and asphaltenes, e.g., about 40 ppm up to more than 1,000 ppm for the combined total amount of nickel and vanadium and up to about 25 wt. % asphaltenes. A unit processing 60,000 barrels of resid per stream day is capable of producing 10% of U.S. vanadium needs per year. Further, the economics of the process of the invention are dependent upon producing a fully demetallized residual by-product, which can be used to make anode grade coke. This process is particularly useful in treating feedstocks with a substantial amount of metals containing 150 ppm or more of nickel and vanadium and having a sulfur content in the range of about 1 wt. % to about 10 wt. %.

Typical feedstocks that can be treated satisfactorily by the process of the present invention contain a substantial amount of components that boil appreciably above 1,000° F. Examples of typical feedstocks are crude oils, topped crude oils, petroleum hydrocarbon residua, both atmospheric and vacuum residua, oils obtained from tar sands and residua derived from tar sand oil, and hydrocarbon streams derived from coal. Such hydrocarbon streams contain organometallic contaminants which create deleterious effects in various refining processes that employ catalysts in the conversion of the particular hydrocarbon stream being treated. The metallic contaminants that are found in such feedstocks include, but are not limited to, iron, vanadium, and nickel.

Nickel is present in the form of soluble organometallic compounds in most crude oils and residuum fractions. The presence of nickel porphyrin complexes and other nickel organometallic complexes causes severe difficulties in the refining and utilization of heavy hydrocarbon fractions, even if the concentration of such complexes is relatively small. It is known that a cracking catalyst deteriorates rapidly and its selectivity changes when in the presence of an appreciable quantity of the organometallic nickel compounds. An appreciable quantity of such organometallic nickel compounds in feedstocks that are being hydrotreated or hydrocracked harmfully affects such processes. The catalyst becomes deactivated and plugging or increasing of the pressure drop in a fixed-bed reactor results from the deposition of nickel compounds in the interstices between catalyst particles.

Iron-containing compounds and vanadium-containing compounds are present in practically all crude oils that are associated with the high Conradson carbon asphaltenic and/or asphaltenic portion of the crude. Of course, such metals are concentrated in the residual bottoms, when a crude is topped to remove those fractions that boil below about 450° F. to 600° F. If such residuum is treated by additional processes, the presence of such metals adversely affects the catalyst in such processes. It should be pointed out that the nickel-containing compounds deleteriously affect cracking catalysts to a greater extent than do iron-containing compounds. If an oil containing such metals is used as a fuel, the metals will cause poor fuel oil performance in industrial furnaces since they corrode the metal surfaces of the furnaces.

While metallic contaminants, such as vanadium, nickel, and iron, are often present in various hydrocarbon streams, other metals are also present in a particular hydrocarbon stream. Such metals exist as the oxides or sulfides of the particular metal, or as a soluble salt of the particular metal, or as high molecular weight organometallic compounds, including metal naphthenates and metal porphyrins, and derivatives thereof.

Another problem associated with the hydroconversion of heavy hydrocarbons is the formation of insoluble carbonaceous substances from the asphaltenic and/or resin fraction of the feedstock which cause operability problems. The amount of such insolubles formed increases with the amount of material boiling over 1,000° F. which is converted or with an increase in the reaction temperature employed. These insoluble substances, also known as Shell hot filtration solids, create the operability difficulties for the hydroconversion unit, and thereby circumscribe the temperatures and feeds the unit can handle. In other words, the amount of solids formed limit the conversion of a given feedstock. Operability difficulties as described above begin to manifest themselves when the solids levels reach about the 1.0 to 1.3 wt. % level. Levels below 1.0 wt. % are generally recommended to prevent fouling of process equipment. The Shell hot filtration solids test is set out in the Journal of the Inst of Petroleum (1951) 37 pp. 596–604, by Van Kerkuoort, W. J. and Nieuwstad, A. J. J., which is incorporated herein by reference.

Although the present invention is in no way limited to the following speculative mechanism, it is believed that such insoluble carbonaceous substances are formed when the heavy hydrocarbons are converted in the hydroconversion unit thereby rendering them a poorer solvent for the unconverted asphaltenic fraction and hence creating the insoluble carbonaceous substances. The process of the present invention decreases the formation of the insolubles by using a catalyst with very large pores so that most of the catalyst surface is accessible to large asphaltenic molecules. Also, the large pores facilitate deposition of nickel and vanadium in the hydrotreating catalyst.

The process of the present invention serves to reduce Shell hot filtration solids formation, and thereby increase operability while simultaneously permitting the conversion of heavy hydrocarbons which are prone to produce large amounts of Shell hot filtration solids and avoiding an unacceptably high catalyst attrition rate.

The present invention can be carried out in a fixed bed reactor or series of fixed bed reactors. The preferred system for the present invention comprises one or a series of ebullated bed reactors. In particular, a three-stage system wherein three ebullated beds are in series is most preferred.

The catalyst of the present invention preferably contains a hydrogenation component. Preferred hydrogenation components are selected from the group consisting of Group VIB metals and Group VIII metals.

The addition of a Group VIII metal to the catalyst of the invention process is especially useful when ebullated bed reactors are employed. In a fixed bed reactor the activity of the catalyst dissipates over time, whereas in the ebullated bed reactor, since fresh amounts of catalyst are continuously or intermittently added, the Group VIII metal provides increased overall average activity since the presence of a Group VIII promoter provides a higher initial activity than the catalyst not containing such a promoter. The freshly added higher initial activity catalyst is included in the weighted average used to determine overall average activity. It has been discovered that relatively small amounts of cobalt present in a hydroconversion catalyst provide excellent hydroconversion activity in an ebullated bed system. This low cobalt-containing hydroconversion catalyst is disclosed and claimed in U.S. Pat. No. 4,657,665. This low cobalt-containing catalyst also has a group VIB metal present in an amount ranging from about 3.5 to about 5.0 wt. % calculated as an oxide and based on total catalyst weight. The cobalt is present in an amount ranging from about 0.4 to about 0.8 wt. % calculated as an oxide (CoO) and based on total catalyst weight.

In any event, the hydrogenation metals can be deposed on a porous inorganic oxide support such as alumina, aluminum phosphate, or aluminum silicates. Suitably, the composition of the hydroconversion catalyst of the present invention comprises from about 3.0 to about 15.0 wt. % of the Group VIB metal, calculated as the oxide. Preferably the Group VIB metal is molybdenum present as a $MoO_3$ in the preferred amount ranging from about 0.75 to about 1.25 wt. % $MoO_3$ per 30 $m^2/g$ of BET surface area present in the catalyst of the invention. The Group VIB and Group VIII classifications of the Periodic Table of Elements can be found on page 628 of WEBSTER'S SEVENTH NEW COLLEGIATE DICTIONARY, G. & C. Merriam Company, Springfield, Mass., U.S.A. (1965). While calculated as the oxide, the hydrogenation metal components of the catalyst can be present as the element, as an oxide thereof, as a sulfide thereof, or mixtures thereof. Molybdenum, which is generally superior to chromium and tungsten in demetallation and desulfurization activity as mentioned above, is the preferred Group VIB metal component in the demetallation catalyst.

The Group VIII metal can be present in an amount ranging from about 0.4 to about 4.0 wt. % calculated as an oxide and based on total catalyst weight. The preferred Group VIII metals are cobalt and nickel. The cobalt and nickel are preferably present in an amount such that the CoO or NiO to Group VIB metal oxide weight ratio varies from about 0.2 to about 0.3.

The hydroconversion catalyst used in the process of the present invention can be prepared by the typical commercial method of impregnating a large-pore, high-surface area inorganic oxide support or any other method known to those skilled in the art. Appropriate commercially available alumina, preferably calcined at about 800°-1,600° ° F. (426°-872° C.), for about 0.5 to about 10 hours, can be impregnated to provide a suitable surface area ranging from about 75 $m^2/gm$ to about 400 $m^2/gm$, and a total pore volume within the range of about 0.5 cc/gm to about 1.5 cc/gm.

Preferably, the surface area ranges from about 150 $m^2/gm$ to about 350 $m^2$, a total pore volume of about 0.8 cc/gm to about 1.2 cc/gm. The meso- and micropore size distribution of the catalyst used in the present invention is irrelevant with respect to the mitigation of solids formation. It is, however, an essential feature of the present invention, that the pore, volume of pores having a diameter greater than 1,200Å range from about 0.1 to about 0.3 cc/g, and that the pore volume of pores having pore diameters greater than 4,000Å be less than about 0.15 cc/g. Preferably the pore volume of pores having pore diameters greater than 1,200Å ranges from about 0.2 to about 0.3 cc/g. The volume of pores having pore diameters greater than 4,000Å is less than about 0.10 cc/g.

The porous refractory inorganic oxide, e.g., alumina can be impregnated with a solution, usually aqueous, containing a heat-decomposable compound of the metal to be placed on the catalyst, drying, and calcining the impregnated material. If the impregnation is to be performed with more than one solution, it is understood that the metals may be applied in any order. The drying can be conducted in air at a temperature of about 80° F. (27° C.) to about 350° F. (177° C.) for a period of 1 to 50 hours. Typically, the calcination can be carried out at a temperature of about 800° F (426° C.) to about 1,200° F. (648° C.) for a period of from 0.5 to 16 hours.

Alternatively, the :norganic oxide support can be prepared by mixing a sol, hydrosol, or hydrogel of the inorganic oxide with a gelling medium, such as ammonium hydroxide followed by constant stirring to produce a gel which is subsequently dryed, pelleted, or extruded, and calcined. The hydrogenation metal(s) can then be incorporated into the support as described above or incorporated during the gelling step.

While the hydroconversion catalyst of the present invention can be present in the form of pellets, spheres, or extrudates, other shapes are also contemplated, such as a clover-leaf shape, cross-shape, or C-shape as disclosed in U.S. Pat. Nos. 3,674,680 and 3,764,565 (Hoekstra, et al.).

The operating conditions for the hydroconversion of heavy hydrocarbon streams, such as petroleum hydrocarbon residua and the like, comprise a hydrogen partial pressure within the range of about 1,000 psia (68 atmos) to about 3,000 psia (204 atmos), an average catalyst bed temperature within the range of about 700° F. (371° C.) to about 850° F. (454° C.), a liquid hourly space velocity (LHSV) within the range of about 0.1 volume of hydrocarbon per hour per volume of catalyst to about 5 volumes of hydrocarbon per hour per volume of catalyst, and a hydrogen recycle rate or hydrogen addition rate within the range of about 2,000 standard cubic feet per barrel (SCFB) (356 $m^3/m^3$) to about 15,000 SCFB (2,671 m3/m3) Preferably, the operating conditions comprise a hydrogen partial pressure within the range of about 1,200 psia to about 2,800 psia (81-136 atmos); an average catalyst bed temperature within the range of about 730° F. (387° C.) to about 820° F. (437° C.); and a LHSV within the range of about 0.15 to about 2; and a hydrogen recycle rate or hydrogen addition rate within the range of about 2,500 SCFB (445 $m^3/m^3$) to about 5,000 SCFB (890 $m^3/m^3$)

If the process of the present invention were to be used to treat hydrocarbon distillates, the operating conditions would comprise a hydrogen partial pressure within the range of about 200 psia (13 atmos) to about 3,000 psia (204 atmos); an average catalyst bed temperature within the range of about 600° F. (315° C.) to about 800° F. (426° C.); a LHSV within the range of about 0.4 volume of hydrocarbon per hour per volume of catalyst to about 6 volumes of hydrocarbon recycle rate or hydrogen addition rate within the range of about 1,000 SCFB (178 $m^3/m^3$) to about 10,000 SCFB (1,381 $m^3/m^3$) Preferred operating conditions for the hydrotreating of hydrocarbon distillates comprise a hydrogen partial pressure within the range of about 200 psia (13 atmos) to about 1,200 psia (81 atmos); an average catalyst bed temperature within the range of about 600° F. (315° C.) to about 750° F. (398° C.); a LHSV within the range of about 0.5 volume of hydrocarbon per hour per volume of catalyst to about 4 volumes of hydrocarbon per hour per volume of catalyst; and a hydrogen recycle rate or hydrogen addition rate within the range of about 1,000 SCFB (178 $m^3/m^3$) to about 6,000 SCFB (1,068 $m^3/m^3$) Generally, the process temperatures and space velocities are selected so that at least 30 vol. % of the feed fraction boiling above 1,000° F. is converted to a product boiling below 1,000° F. and more preferably so that at least 60 vol. % of the subject fraction is converted to a product boiling below 1,000° F.

EXAMPLE 1

The present example was carried out to demonstrate the process of the invention's ability to affect reduction in solids formation with the requisite macropore volume, specified in accordance with the invention versus comparative catalysts not having the stipulated macropore volume.

A feedstock having the following properties as set out in Table I was used in the present example.

TABLE I

| Feedstock Properties | |
|---|---|
| °API | 6.0 |
| Sulfur, wt. % | 4.6 |
| Ramsbottom carbon residue, wt. % | 22.4 |
| Nickel, ppm | 56 |
| Vanadium, ppm | 255 |
| Wt. % boiling below 1,000° F. | 8.0 |

The process conditions employed to effect 65 vol% conversion of the fraction boiling over 1,000° F. to material boiling below 1,000° F. of the above-described vacuum resid are set out in Table II.

TABLE II

| Process Conditions | |
|---|---|
| Temperature, °F. | 760–790 |
| LHSV, volume oil/hr/volume catalyst | 0.1–0.3 |
| $H_2$ partial pressure, psia | 1750–2000 |
| $H_2$ rate, SCFB | 5000–10,000 |

Two types of hydroconversion reactors were employed in the present example designated as Type 1 and Type 2.

In the Type 1 reactor, a tubular reactor having a ⅝-inch internal diameter and a 36-inch length was utilized. In each case sufficient catalyst was weighed to equal either ½ or ⅓ the volume of the reactor in its hot isothermal zone. If ½ the reactor volume of catalyst was used, it was mixed with an equal volume of 14–20 U.S. mesh size particles of porous Alundum before the loading. If non-porous Alundum chips (14–20 mesh) were used to dilute the catalyst bed, two volumes of Alundum plus one volume of catalyst were mixed. The reactor was loaded with 8–12 mesh Alundum up to the isothermal zone. The diluted catalyst was then added and the non-isothermal top part of the reactor was also filled with non-porous 8–12 mesh Alundum up to within about 4 cm below the reactor outlet.

In the Type 2 reactor, 6,500 cc of the appropriate catalyst were loaded into each of three reactors. The reactors are two inches in diameter and 180 inches in length. These reactors were operated with a liquid recycle to expand the catalyst bed to 135% of its settled volume. The operating conditions employed are those set out in Table II.

The various catalysts employed and their respective properties in the example are set out in Table III. Note that catalyst A, B, C, and J designate tests where two different catalysts were loaded into the reactors. The two valves under each of the $MoO_3$ and CoO columns designate the respective metal loadings of each of the two catalysts employed in the subject tests.

TABLE III

| Catalyst Properties | | | | | | | |
|---|---|---|---|---|---|---|---|
| Catalyst | System Type[1] | Reactor Type[2] | BET Area ($m^2/g$) | Total PV cc/g | PV of >1200Å pores cc/g | $MoO_3$ | CoO |
| A | 2 | 1 | 230 | .72 | .05 | 16.0, 18.0 | 3.2, 0 |
| B | 2 | 1 | 186 | .57 | .06 | 4.1, 10.3 | 0, 0 |
| C | 2 | 1 | 230 | .72 | .05 | 16.0, 10.0 | 3.2, 0 |
| D | 1 | 2 | 288 | .83 | .08 | 12.4 | 3.5 |
| E | 1 | 1 | 344 | .83 | .12 | 13.6 | 2.4 |
| F | 1 | 1,2 | 318 | .85 | .16 | 14.7 | 3.7 |
| G | 1 | 1 | 312 | .87 | .17 | 16.0 | 3.2 |
| H | 1 | 1 | 308 | .94 | .17 | 13.7 | 3.4 |
| I | 1 | 1 | 313 | .81 | .19 | 13.3 | 3.5 |
| J | 2 | 1 | 274 | .96 | .22 | 4.5, 14.7 | 0, 3.7 |

[1]System type is the number of different catalyst types loaded. Where more than 1, pore volume and surface areas shown are average values.
[2]Reactor type 1 = fixed bed; 2 = three-stage expanded bed.

FIG. 1 shows a plot of the Shell hot filtration solids as function of each catalyst's macropore volume for a conversion level of 65 vol% of the material boiling over 1,000° F. to a material boiling below 1,000° F. Note that catalysts E, F, G, H, I, and J in accordance with the present invention result in acceptable Shell hot filtration solids formation, i.e., less than about 1.0 wt. %. Comparative catalysts A, B, C, and D produced an unacceptable amount of Shell hot filtration solids.

EXAMPLE II

The present example was carried out to demonstrate the efficacy of the present invention with respect to minimization of the attrition rate. Tests on various catalysts possessing the properties set out in Table IV were carried out as follows.

For each catalyst sample, about 100 grams thereof were passed over a U.S. 30 mesh sieve to remove fines. Each sample was then calcined at 1,000° F. for about one hour. Each sample was subsequently cooled to room temperature in a desiccator. Each sample weight, W(b) was then recorded. Each sample was then placed in an abrasion test drum as described in ASTM method D4058, followed by a tumbling of the drum at 60 rpm for 22 hours. Each sample was then removed from the drum and passed over a U.S. 30 mesh size screen. Each sample was then recalcined at 1,000° F. for one hour. Each sample was hen cooled to room temperature and placed in a desiccator. Each sample was then again weighed W(b) and recorded.

The loss on attrition (LOA) was then calculated for each sample in accordance with the following formula:

$$LOA = \frac{24\,[W(b) - W(a)]}{22\,W(b)} \times 100$$

Figure 2:
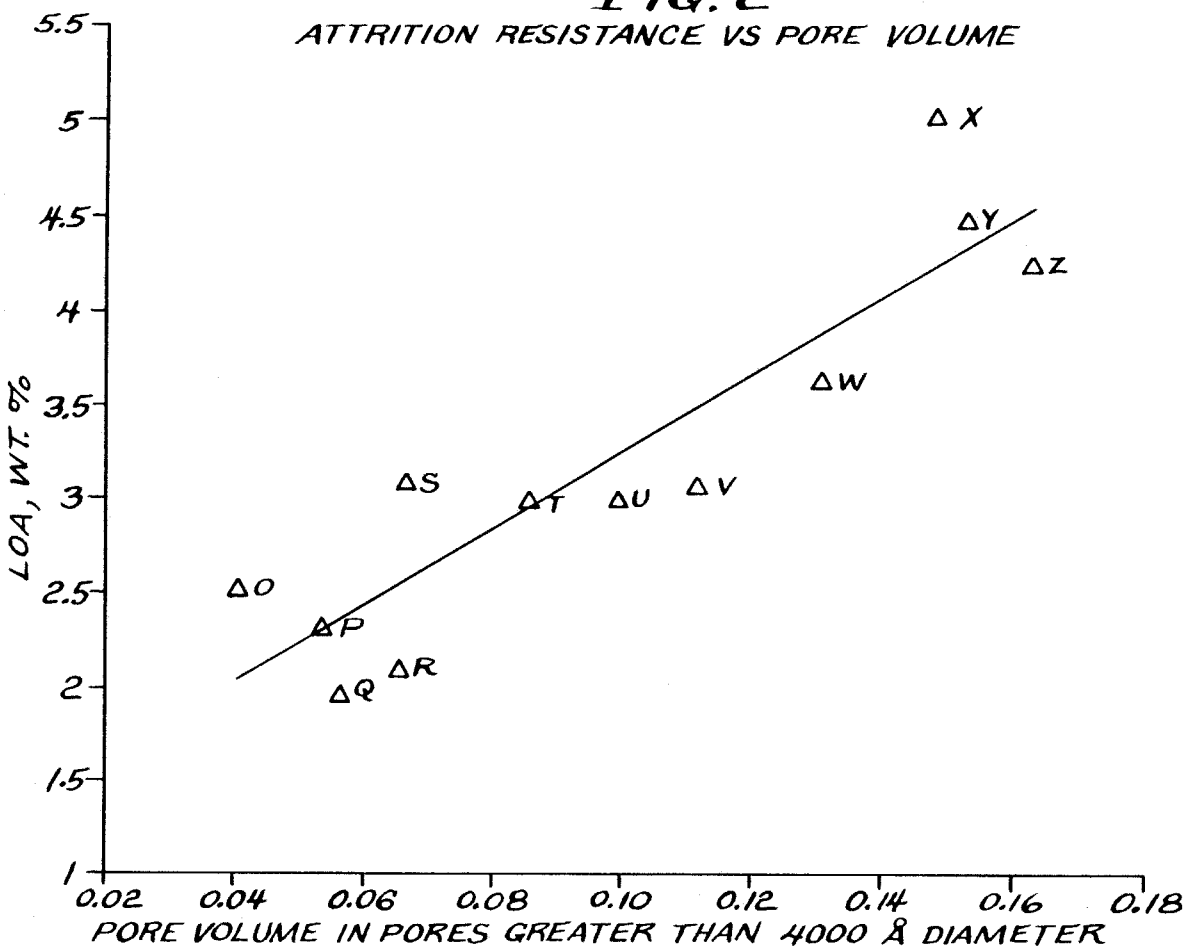
FIG. 2 depicts a plot of loss on attrition for various catalysts versus pore volume of pores having diameters greater than 4,000Å.

FIG. 2 depicts a plot of "loss on attrition" versus the pore volume of pores greater than 4,000Å diameter for the tests carried out above. Catalysts O through W are in accordance with the process of the invention. Catalysts O through U are in accordance with a preferred aspect of the invention. Catalysts X, Y, and Z are comparative catalysts and not in accordance with the present invention.

Previous experience in large expanded bed reactors has shown that values of LOA above 5% result in unacceptably high rates of catalyst attrition. Values below 3% provide acceptable performance, and thus a maximum of 3% is desirable, and values greater than 5% are clearly unacceptable. The results of the present example clearly demonstrate that catalysts in accordance with the present invention having a value of 0.15 cc/g as the maximum allowable pore volume for pores with greater than 4,000 Å diameters provide a reduction in attrition rate.

TABLE IV

| Catalyst | BET Surface Area | Catalyst Properties PV in Pores > 1200Å | PV > 4000Å | LOA |
|---|---|---|---|---|
| O | 280 | .20 | .040 | 2.54 |
| P | 299 | .19 | .065 | 2.11 |
| Q | 278 | .19 | .056 | 1.97 |
| R | 299 | .19 | .053 | 2.33 |
| S | 286 | .22 | .066 | 3.10 |
| T | 290 | .21 | .085 | 3.00 |
| U | 319 | .20 | .099 | 3.01 |
| V | 262 | .19 | .111 | 3.08 |
| W | 278 | .23 | .130 | 3.64 |
| X | 281 | .24 | .147 | 5.05 |
| Y | 281 | .23 | .152 | 4.50 |
| Z | 278 | .25 | .162 | 4.26 |

What is claimed is:

1. A process for the hydrodemetallation, hydrodesulfurization, and hydrocracking of a hydrocarbon feedstock containing asphaltenes, and Shell hot filtration solids precursors and conversion of at least 30 vol. % of the feedstock fraction boiling over 1,000° F. to material boiling below 1,000° F. wherein the formation of Shell hot filtration solids is maintained below a level of about 1.0 wt. % which comprises contacting said feedstock in at least one ebullated bed with hydrogen under hydrocracking conditions with a catalyst comprising a porous inorganic oxide wherein said catalyst has a pore volume of pores having a diameter greater than about 1,200 Angstroms of about 0.2 to about 0.3 cc/gm and has no more than about 0.15 cc/gm pore volume in pores having a diameter greater than about 4,000 Angstroms.

2. The process of claim 1 wherein said catalyst further comprises a hydrogenation component selected from the group consisting of Group VIB metals and Group VIII metals.

3. The process of claim 2 wherein said Group VIB metal is present in an amount ranging from about 3.0 to about 15.0 wt. % calculated as the oxide thereof and based on total catalyst weight.

4. The process of claim 3 wherein said Group VIB metal is molybdenum.

5. The process of claim 3 wherein said catalyst further comprises a Group VIII metal selected from the group consisting of nickel and cobalt.

6. The process of claim 5 wherein said Group VIII metal is present in an amount ranging from about 0.4 to 4.0 wt. % calculated as an oxide and based on total catalyst weight.

7. The process of claim 4 wherein said molybdenum is present in an amount ranging from 0.75 to 1.25 wt. % as $MoO_3$ and based on total catalyst weight and per 30 $m^2/g$ BET surface area of the catalyst.

8. The process of claim 7 wherein said Group VIII metal selected from the group consisting of cobalt and nickel is present in an amount such that the weight ratio of the cobalt and nickel calculated as CoO and NiO, respectively, to molybdenum calculated as $MoO_3$ is present in an amount ranging from about 0.2 to 0.3.

9. The process of claim 1 wherein said process is carried out in at least one ebullated bed reactor.

* * * * *